US010259134B2

(12) United States Patent
Guo et al.

(10) Patent No.: US 10,259,134 B2
(45) Date of Patent: Apr. 16, 2019

(54) SLICING MECHANISM AND SLICER USING THE SLICING MECHANISM

(71) Applicant: GUANGDONG XINBAO ELECTRICAL APPLIANCES HOLDINGS CO., LTD., Foshan, Guangdong (CN)

(72) Inventors: Jiangang Guo, Guangdong (CN); Dingxun Sheng, Guangdong (CN)

(73) Assignee: Guangdong Xinbao Electrical Appliances Holdings Co., Ltd. (CN)

( * ) Notice: Subject to any disclaimer, the term of this patent is extended or adjusted under 35 U.S.C. 154(b) by 435 days.

(21) Appl. No.: 15/144,730

(22) Filed: May 2, 2016

(65) Prior Publication Data

US 2017/0057110 A1 Mar. 2, 2017

(51) Int. Cl.

| | |
|---|---|
| ***B26D 5/08*** | (2006.01) |
| ***B26D 7/06*** | (2006.01) |
| ***B26D 1/12*** | (2006.01) |
| ***B26D 1/143*** | (2006.01) |
| *B26D 3/28* | (2006.01) |
| *B26D 3/11* | (2006.01) |

(52) U.S. Cl.

CPC ..... *B26D 5/086* (2013.01); *B26D 1/12* (2013.01); *B26D 1/143* (2013.01); *B26D 7/0608* (2013.01); *B26D 7/0641* (2013.01); *B26D 3/11* (2013.01); *B26D 2003/285* (2013.01); *B26D 2003/288* (2013.01)

(58) Field of Classification Search

CPC ..... B26D 5/086; B26D 1/12; B26D 1/143; B26D 7/0608; B26D 7/0641; B26D 3/11; B26D 2003/285; B26D 2003/288; B26D 1/43

See application file for complete search history.

(56) References Cited

U.S. PATENT DOCUMENTS

| | | | | |
|---|---|---|---|---|
| 4,691,870 A * | 9/1987 | Fukunaga | A47J 43/046 241/282.2 |
| 7,520,453 B2 * | 4/2009 | Clapp | A47J 43/0772 241/282.1 |
| 8,726,524 B2 * | 5/2014 | Whited | A22B 5/165 30/276 |
| 2004/0088864 A1 * | 5/2004 | Whited | B26B 25/002 30/123 |
| 2011/0185580 A1 * | 8/2011 | Whited | A22B 5/165 30/276 |
| 2016/0031103 A1 * | 2/2016 | Mascari | B26B 25/002 30/124 |

* cited by examiner

*Primary Examiner* — Omar Flores Sanchez

(57) ABSTRACT

The present invention relates to the field of food processors, and more particularly, to a slicing mechanism and the slicer using the slicing mechanism, wherein the slicing mechanism comprises the lower cover and the cutter components; wherein the cutter components are fixed to the rotating gear, which rotates in the lower cover; wherein the rotating gear and the cutter components are directly fixed, improving transmission efficiency and stability so that the slicing process has higher uniformity and quality.

12 Claims, 4 Drawing Sheets

SLICING MECHANISM AND SLICER USING THE SLICING MECHANISM

FIELD OF THE INVENTION

The present invention relates to the field of food processors, and more particularly, to a slicing mechanism and the slicer using the slicing mechanism.

BACKGROUND OF THE INVENTION

As living standards generally increase worldwide, people are demanding higher quality food. The food processor-specifically, the food slicer—has become a critical tool in every family's kitchen.

The traditional slicer operated manually, which was time-consuming and laborious. Specifically, traditional slicers were inefficient due to the unstable input force generated by the human user. To address this problem, a great deal of research was invested to develop a more efficient electrical slicer.

Several foreign patents embody this research. Specifically, Chinese Disclosure No.: CN203400062U discloses a blender with a cone-shaped slicing mechanism, replacing the original blending device by the slicing mechanism. The blender comprises a driving motor, speed reducer, coupling, input shaft, steering gears and rotating cutter shaft. A shock-absorbing device is disposed between the coupling and the input shaft, and steering gears are fixed to the input shaft and the rotating cutter shaft. However, the distance of transmission is too long, seriously affecting the validity and power of transmission. Even worse, the blender has high maintenance costs, and the food material is not sliced uniformly due to the device's low stability. Moreover, the device breaks down the food unevenly during the slicing process, producing uneven and broken food parts. Therefore, there is room for much improvement in this field.

SUMMARY OF THE INVENTION

The purpose of the present invention is to provide a slicing mechanism and a slicer using this slicing mechanism, improving the transmission efficiency and stability greatly so that the uniformity of slicing process can be achieved. Meanwhile, the food does not easily break apart during the slicing process, unlike traditional slicers.

To achieve the above purpose, the present invention adopts the following technical solution:

The slicing mechanism of the present invention comprises the lower cover and the cutter components. The cutter components are connected to the rotating gear located in the lower cover. The rotating gear and the cutter components are directly fixed to each other. This arrangement makes the slicer more efficient and stable than the prior art.

According to the above solution, the upper storing cylindrical cavity is formed at the inner upper part of the lower cover, and the lower storing cylindrical cavity is formed at the inner lower part of the lower cover. The upper storing cylindrical cavity is arranged coaxially with the lower storing cylindrical cavity, and the radius of the upper storing cylindrical cavity is larger than that of the lower storing cylindrical cavity. The annular stepping-part is formed at the joint between the upper storing cylindrical cavity and the lower storing cylindrical cavity. The rotating gear is disposed in the upper storing cylindrical cavity, and the cutter components are restricted by the locating device to move upwards and downwards. The upper end of the cutter components is coupled to the rotating gear, and the lower end of the cutter components extends into the lower storing cylindrical cavity. The installation structure of the rotating gear is further detailed herein.

According to the above solution, the anti-wear device is disposed between the rotating gear and the annular stepping-part so that the rotating gear can impel the cutter components better, prolonging the life-span of the present invention.

According to the above solution, a plurality of installation holes are provided along the direction of the upper circumference of the annular stepping-part. A rotating wheel, which can rotate with the rotating gear, is disposed in the installation hole. When the rotating gear rotates, the rotating wheel can rotate together with the rotating gear, reducing the friction of the rotating gear and improving the transmission efficiency.

According to the above solution, the locating device comprises an upper cover. A feeding inlet is formed inside of the upper cover. The bottom of the upper cover is engaged with the upper part of the lower cover, preventing the cutter from moving upwards or downwards and enhancing the stability of the slicing process.

According to the above solution, a plurality of locating convex parts is provided at the outer circumference of the bottom of the feeding inlet. The plurality of locating convex parts is arranged to match the cutter components correspondingly. Therefore, the locating convex parts are connected to the cutter components, confining the location of the cutter components and reducing the friction of the cutter components effectively.

According to the above solution, a plurality of sleeve pipes is disposed at the outer circumference of the bottom of the feeding inlet. The plurality of locating convex parts is correspondingly disposed inside of a plurality of sleeve pipes. A compression spring is disposed between the locating convex part and the bottom of the sleeve pipe so that the acting force between the locating convex parts and the cutter components can be further reduced.

According to above solution, a through-hole is formed in the middle part of the rotating gear, and the rotating gear of the outer circumference of the through-hole is provided with a plurality of locating slots. The cutter components comprise a flange and a cutter rack, which is fixed in the middle position of the bottom of the flange. The cutter rack is provided with cutting blades and the circumference of the bottom of the flange is provided with a plurality of locating strips. The rotating gear and the cutter components are connected in a matching manner through the interaction between the plurality of locating slots and the plurality of locating strips. This structure is more compact than the prior art, and makes for easier assembly and disassembly of the device.

According to above solution, the cutting blades comprise a cutting blade A. The cutting blade A is fixed on the cutter rack for easy slicing the food material.

According to the above solution, the cutting blades further comprise cutting blades B. The cutting edge of the cutting blade A and the cutting edges of cutting blades B are placed crosswise, which can effectively adjust the slicing shape of the food material so as to satisfy people's various requirements of foods.

According to the above solution, a detachable charging bar is inserted in the inner cavity of the feeding inlet of the upper cover. The bottom of the charging bar is provided with a rotation-stopping device A. Alternatively, the inner side wall of the feeding inlet is provided with a rotation-stopping device B, which can prevent the food material from rotating during the slicing process and enhance the stability of the slicing process.

The slicer of the present invention comprises the base components, the speed-reducing components, the storing part and the slicing mechanism. The speed-reducing components are disposed on the base components. The speed-reducing components impel the rotating gear of the slicing mechanism to rotate. The storing part is correspondingly disposed at the lower part of the slicing mechanism.

The slicing mechanism of the present invention comprises the lower cover, the rotating gear and the cutter components. The rotating gear is connected to the cutter components. The rotating gear is rotationally disposed in the lower cover, which shortens the distance between the mechanical transmission parts and improves the transmission efficiency and stability. Therefore, the slicing process has higher uniformity and quality.

1. Slicing Mechanism; 11. Charging Bar; 111. Rotation-stopping Mechanism A; 12. Upper Cover; 121. Sleeve Pipe; 122. Locating Convex Part; 123. Feeding Inlet; 124. Rotation-stopping Mechanism B; Feeding Inlet; 13. Rotating Gear; 131. Locating Slot; 132. Through-hole; 14. Rotating Wheel; 15. Lower Cover; 151. Upper Storing Cylindrical Cavity; 152. Lower Storing Cylindrical Cavity; 153. Annular stepping-part; 154. Installation Hole; 16. Cutter Components; 161. Flange; 162. Cutter Rack; 163. Locating Strip; 164. Cutting Blade A; 165. Cutting Blade B; 2. Speed-reducing Components; 3. Storing Part; 4. Base Components; 41. Supporting Part.

DETAILED DESCRIPTION OF THE INVENTION

Figure 1:
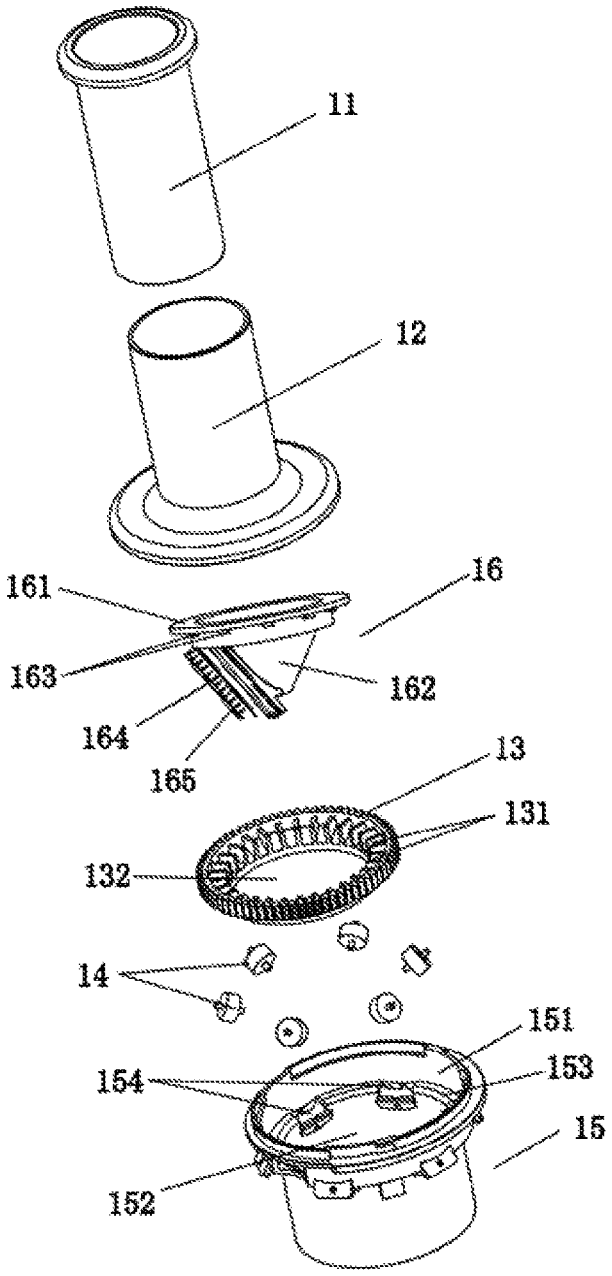
FIG. 1 is a breakdown structure diagram of the slicing mechanism of the present invention.
Figure 2:
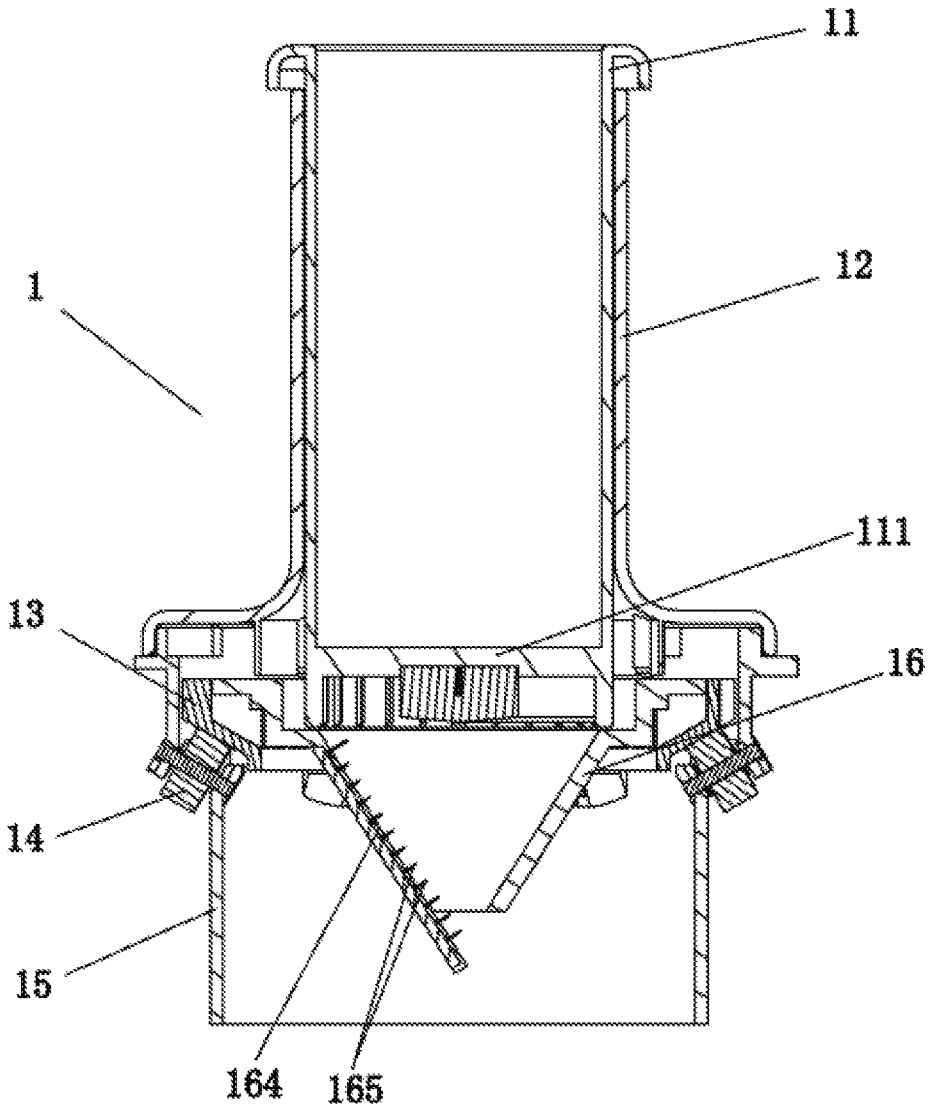
FIG. 2 is a sectional view of the slicing mechanism of the present invention.
Figure 3:
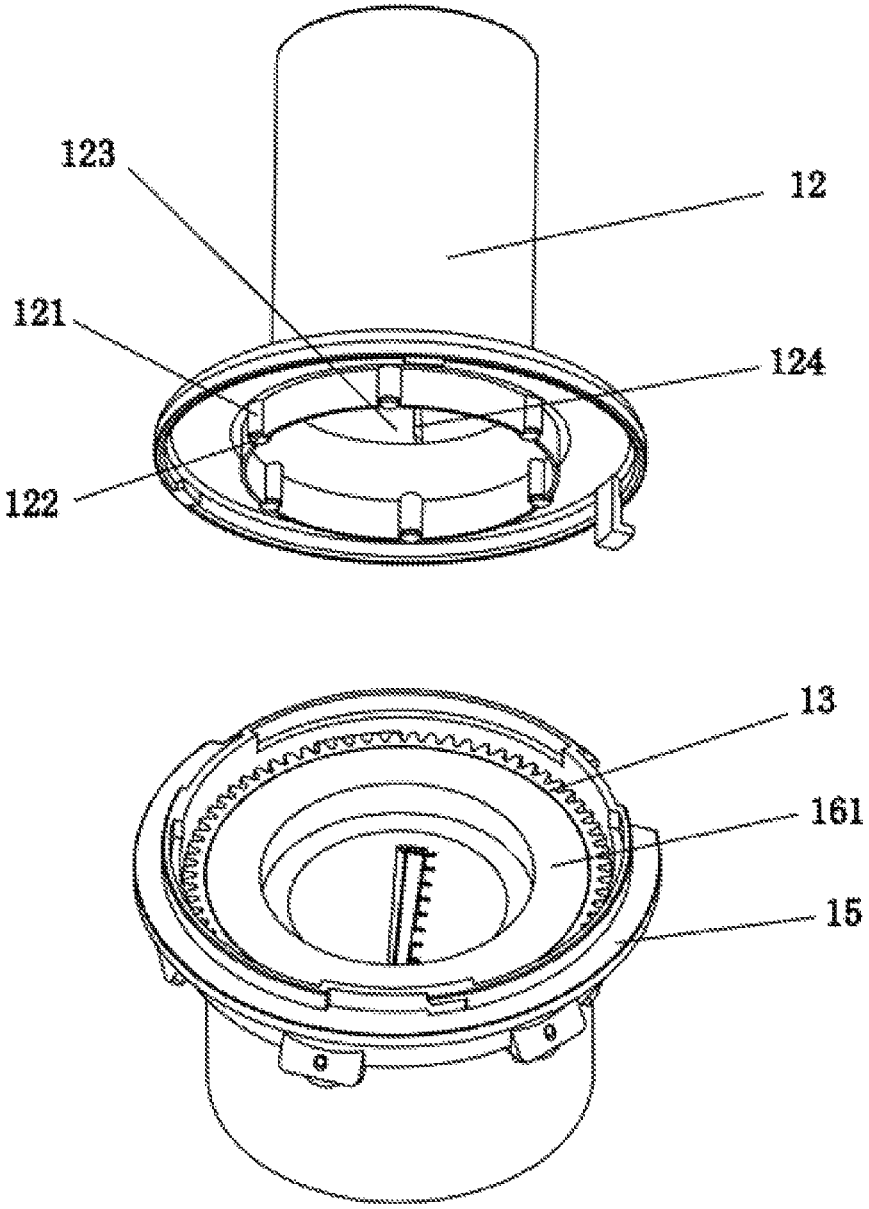
FIG. 3 is a part of the breakdown structure diagram of the slicing mechanism of the present invention.

FIGS. 1 through 3, discussed below, and the various embodiments used to describe the principles of the present invention in this patent document are by way of illustration only and should not be construed in any way to limit the scope of the invention. Those skilled in the art will understand that the principles of the present invention may be implemented in suitably arranged subscriber integrated access device.

As shown in FIG. 1 and FIG. 3, the slicing mechanism of the present invention comprises the lower cover 15 and the cutter components 16. The cutter components 16 are fixed to the rotating gear 13, which rotates in the lower cover 15.

More specifically, the upper storing cylindrical cavity 151 is formed at the inner upper part of the lower cover 15, and the lower storing cylindrical cavity 152 is formed at the inner lower part of the lower cover 15. The upper storing cylindrical cavity 151 is arranged coaxially with the lower storing cylindrical cavity 152 and the radius of the upper storing cylindrical cavity 151 is larger than that of the lower storing cylindrical cavity 152. The annular stepping-part 153 is formed at the joint between the upper storing cylindrical cavity 151 and the lower storing cylindrical cavity 152. The rotating gear 13 rotates in the upper storing cylindrical cavity 151, and the cutter components 16 are restricted by the locating device to move upwards and downwards. The upper end of the cutter components 16 is coupled to the rotating gear 13, and the lower end of the cutter components 16 extends into the lower storing cylindrical cavity 152.

When in use, the food material is fed into the cutter components 16 through the feeding inlet. The driving device impels the rotating gear 13 and the cutter components 16 to rotate together so that the cutter components 16 can work to slice the food material. The rotating gear 13 is connected to the cutter components 16 so that the transmission distance is short, improving the transmission efficiency and stability. The uniformity of the slicing process is improved and the food material is not easily broken.

An anti-wear device is disposed between the rotating gear 13 and the annular stepping-part 153 so that the transmission efficiency and stability can be further improved. More specifically, a plurality of installation holes 154 is disposed along the direction of the upper circumference of the annular stepping-part 153. A rotating wheel 14, which can rotate with the rotating gear 13, is disposed in the installation hole 154. When the rotating gear 13 is disposed in the upper storing cylindrical cavity 151, it is also disposed on the rotating wheel 14. Meanwhile, when the driving device impels the rotating wheel 13, the rotating wheel 14 rotates together with the rotating gear 13, reducing the friction between the rotating gear 13 and the annular stepping-part 153 effectively.

The locating device comprises an upper cover 12. A feeding inlet 123 is formed inside of the upper cover 12. The bottom of the upper cover 12 is engaged with the upper part of the lower cover 15, confining the moving location of the cutter components 16 and the rotating gear 13 in an upward and downward direction through the upper cover 12 and enhancing the stability of the slicing process.

A plurality of locating convex parts 122 are disposed at the outer circumference of the bottom of the feeding inlet 123. The plurality of locating convex parts 122 is arranged to match the cutter components 16 correspondingly. When in use, the plurality of locating convex parts 122 is contacted with the cutter components 16. Therefore, when confining the upward and downward location of the cutter components 16 and the rotating gear 13, the friction between them can also be reduced. Preferably, a plurality of sleeve pipes 123 are disposed at the outer circumference of the feeding inlet 123. The plurality of locating convex parts 122 are disposed in the plurality of sleeve pipes 121 correspondingly. A compression spring is disposed between the locating convex part 122 and the bottom of the sleeve pipe 121. The compression spring enables the locating convex part 122 to contact with the cutter components 16, and further reduce the friction between the locating convex part 122 and the cutter components 16.

A through-hole 132 is formed in the middle part of the rotating gear 13, and the rotating gear 13 of the outer circumference of the through-hole 132 is provided with a plurality of locating slots 131. The cutter components 16 comprise a flange 161 and a cutter rack 162, which is fixed in the middle position of the bottom of the flange 161. The cutter rack 162 is provided with cutting blades and the circumference of the bottom of the flange 161 is provided with a plurality of locating strips 163. The rotating gear 13 and the cutter components 16 are connected correspondingly through the interaction between the plurality of locating slots 131 and the plurality of locating strips 163. This structure facilitates the assembly and disassembly and is more compact. This arrangement also provides greater stability between the rotating gear 13 and the cutter components 16, creating a uniform slicing process.

Regarding the concrete structure of the cutting blades, the present invention has two embodiments. In the first exemplary embodiment of the present invention, the cutting blades comprise the cutting blade A164, and the cutting blade 164 is fixed on the cutter rack 162 for cutting the food material into slices.

In the second exemplary embodiment of the present invention, the cutting blades comprise the cutting blade A164 and a plurality of cutting blades B165; the cutting edge of the cutting blade A164 and the cutting edges of the plurality of cutting blades A165 are placed crosswise. Therefore, the angle, height and width of the crosswise-placed cutting edges of the cutting blade A164 and the plurality of cutting blades A165 can be adjusted to produce different shapes of the cross section of the shredded food. For instance, the cross-section can be prismatic or triangular. Through adjusting the cutting blade A164 and the plurality of cutting blades B165, the shredded food material can be formed in a round or elliptical shape, etc. Further, the height and width of the cutting blade A164 and the plurality of cutting blades B165 can be adjusted to produce a cross-section of the shredded food with varying thickness. And the device can slice the food material without adding cutting blades B165, so as to satisfy the people's various requirements of food materials.

A detachable charging bar 11 is inserted in the feeding inlet 123 of the upper cover 12. It should be emphasized that the bottom of the charging bar 11 is provide with a rotation-stopping device A111, or, the inner wall of the feeding inlet 123 is provided with a rotation-stopping device B124. More specifically, the rotation-stopping device is a fin-shaped structure disposed at the bottom of the charging bar 11, or on the inner wall of the feeding inlet 123. When the food material is fed from the feeding inlet 123 of the upper cover 12, the charging bar 11 can be used to push the food material into the rotating cutter components 16. Further, the rotation-stopping device A or the rotation-stopping device B can prevent the food material from rotating with the cutter components 16 to ensure a more stable slicing process.

Figure 4:
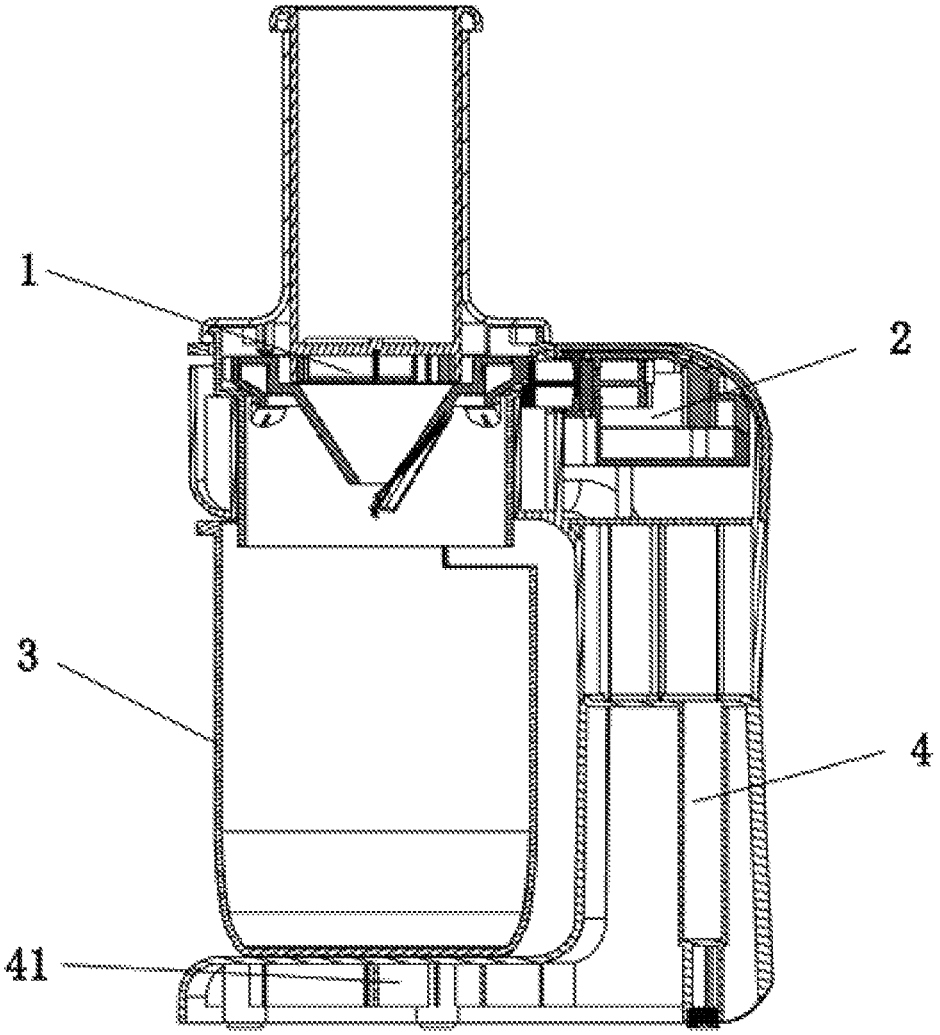
FIG. 4 is an overall structure diagram of the slicing mechanism of the present invention.

As shown in FIG. 4, the slicer of the present invention comprises the base components 4, the speed-reducing components 2, the storing part 3 and the slicing mechanism 1. The speed reducing components 2 are disposed on the base components 4, and the slicing mechanism 1 is impelled by the speed-reducing components 2. The storing part 3 is disposed at the lower part of the slicing mechanism 1. More specifically, the speed-reducing components 2 are gear components. The gear components correspond to the rotating gear 13 so as to impel the rotating gear 13 to rotate.

The base components 4 are provided with a supporting part 41, and the storing part 3 is disposed on the supporting part 41. The food material sliced by the slicing mechanism 1 can be stored in the storing part 3.

The present invention has the advantages of high transmission efficiency, strong stability, high uniformity and durability.

Although the present invention has been described in detail, those skilled in the art should understand that they can make various changes, substitutions and alterations herein without departing from the spirit and scope of the invention in its broadest form.

The invention claimed is:

1. A slicing mechanism, comprising a lower cover and cutter components, wherein the cutter components are fixed to the rotating gear, which is rotates in the lower cover, wherein an upper storing cylindrical cavity is formed at the inner upper part of the lower cover and a lower storing cylindrical cavity is formed at the inner lower part of the lower cover; wherein the upper storing cylindrical cavity is arranged coaxially with the lower storing cylindrical cavity; wherein the radius of the upper storing cylindrical cavity is larger than that of the lower storing cylindrical cavity;

wherein an annular stepping-part is formed at the joint between the upper storing cylindrical cavity and the lower storing cylindrical cavity; wherein the rotating gear is rotationally disposed in the upper storing cylindrical cavity; wherein the cutter components are restricted by the locating device to move upwards and downwards; wherein the upper end of the cutter components is coupled to the rotating gear and the lower end of the cutter components extends into the lower storing cylindrical cavity.

2. The slicing mechanism of claim 1, wherein an anti-wear device is disposed between the rotating gear and the annular stepping-part.

3. The slicing mechanism of claim 2, wherein a plurality of installation holes are disposed along the direction of the upper circumference of the annular stepping-part;

wherein a rotating wheel, which can rotate with the rotating gear, is disposed in the installation hole.

4. The slicing mechanism of claim 3, wherein the locating device comprises an upper cover; wherein a feeding inlet is formed inside of the upper cover; wherein the bottom of the upper cover is engaged with the upper part of the lower cover.

5. The slicing mechanism of claim 4, wherein a plurality of locating convex parts are disposed at the outer circumference of the bottom of the feeding inlet; wherein the plurality of locating convex parts are arranged to match the cutter components correspondingly.

6. The slicing mechanism of claim 5, wherein a plurality of sleeve pipes is disposed at the outer circumference of the bottom of the feeding inlet; wherein the plurality of locating convex parts is disposed inside of the plurality of sleeve pipes correspondingly;

wherein a compression spring is disposed between the locating convex part and the bottom of the sleeve pipe.

7. The slicing mechanism of claim 1, wherein a through-hole is formed in the middle part of the rotating gear; wherein the rotating gear of the outer circumference of the through-hole is provided with a plurality of locating slots; wherein the cutter components comprise a flange and a cutter rack, which is fixed in the middle position of the bottom of the flange;

wherein the cutter rack is provided with cutting blades; wherein the circumference of the bottom of the flange is provided with a plurality of locating strips; wherein the rotating gears and the cutter components are connected through the interaction between the plurality of locating slots and the plurality of locating strips.

8. The slicing mechanism of claim 3, wherein the cutting blades comprise a cutting blade A; wherein the cutting blade A is fixed on the cutter rack.

9. The slicing mechanism of claim 8, wherein the cutting blades further comprise cutting blades B; wherein the cutting edge of the cutting blade A and the cutting edges of cutting blades B are placed crosswise.

10. The slicing mechanism of claim 4, wherein a detached charging bar is inserted in the inner cavity of the feeding inlet of the upper cover; wherein the bottom of the charging bar is provided with a rotation-stopping device A.

11. The slicing mechanism of claim 4, wherein a detached charging bar is inserted in the inner cavity of the feeding inlet of the upper cover; wherein the inner side wall of the feeding inlet is provided with a rotation-stopping device B.

12. A slicer adopting the slicing mechanism of claims 10, comprising:

the base components, the speed-reducing components, the storing part and the slicing mechanism;

wherein the speed-reducing components are disposed on the base components; wherein the speed-reducing components impel the rotating gears of the slicing mechanism to rotate;

wherein the storing part is correspondingly disposed at the lower part of the slicing mechanism.

* * * * *